US006317932B1

(12) United States Patent
Staples et al.

(10) Patent No.: US 6,317,932 B1
(45) Date of Patent: Nov. 20, 2001

(54) INLET DESIGN FOR HANDLING BULK TEXTILE FIBER

(75) Inventors: Phillip O. Staples, Nashville; Todd A. McCoy, Hendersonville; Lyles H. Sowell, Old Hickory; Andrew J. Giles, Joelton; John M. Dakin, Madison, all of TN (US); Nathan Cory Jetton, Richmond, VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/318,004

(22) Filed: May 25, 1999

Related U.S. Application Data

(60) Provisional application No. 60/087,060, filed on May 28, 1998.

(51) Int. Cl.[7] ..... D01G 15/40

(52) U.S. Cl. ..... 19/105; 19/296; 19/304

(58) Field of Search ..... 19/65 A, 66 R, 19/97.5, 98, 99, 100, 105, 200, 204, 205, 304, 305, 296

(56) References Cited

U.S. PATENT DOCUMENTS

| | | | | |
|---|---|---|---|---|
| 2,316,451 | * | 4/1943 | Page | 19/305 |
| 3,738,476 | | 6/1973 | Hullett et al. | 198/58 |
| 3,981,047 | * | 9/1976 | Contractor et al. | 19/296 |
| 4,154,485 | | 5/1979 | Lytton et al. | 406/70 |
| 4,449,272 | | 5/1984 | Cash | 19/105 |
| 4,864,693 | * | 9/1989 | Pinto et al. | 19/105 |
| 4,930,190 | | 6/1990 | Leifeld | 19/105 |
| 5,157,809 | | 10/1992 | Genevray | 19/105 |
| 5,606,776 | | 3/1997 | Freund et al. | 19/105 |
| 5,974,631 | * | 11/1999 | Leifeld | 19/304 |

FOREIGN PATENT DOCUMENTS

| | | | |
|---|---|---|---|
| 36 32 934 A1 | 4/1988 | (DE) | D01G/23/02 |
| 0 737 762 A | 10/1996 | (FR) | D01G/23/02 |
| WO 96 29453 A | 9/1996 | (WO) | D01G/23/00 |
| WO 99/18270 | 4/1999 | (WO) | D01G/23/02 |

* cited by examiner

*Primary Examiner*—John J. Calvert
*Assistant Examiner*—Gary L. Welch

(57) ABSTRACT

The invention is particularly related to the problems of dispersing fiber to obtain a uniform distribution. The invention includes tapered ducts oriented at an appropriate angle relative to the horizontal for redirecting and decreasing the speed of an air stream containing fiber therein such that the fiber precipitates from the air stream and falls gently to form a uniform fiber bed in a bin.

19 Claims, 6 Drawing Sheets

INLET DESIGN FOR HANDLING BULK TEXTILE FIBER

This application claims benefit of Provisional No. 60/087,060 filed May 28, 1998.

FIELD OF THE INVENTION

This invention relates to collecting dry textile fiber and delivering the collected fiber to textile machinery and more particularly to forming the collected dry textile fiber into a batt to be fed to a textile machine.

BACKGROUND OF THE INVENTION

Many types of textile processing equipment, such as carding machines and airlay web formers, are designed to receive textile fiber from a bale in the form of a batt wherein the batt is formed of a collection of tufts of fiber. In the operation of such textile equipment, the tufts are conventionally pulled or taken whole into the textile equipment. Exceptionally large tufts may overload the textile equipment by providing too much fiber at once. Thus, it is preferred that the batts are formed with smaller tufts therein and the feed rates are set to accommodate the largest remaining tufts. In addition, bale opening equipment and perhaps other equipment are used to open the bales of fiber and break the tufts into smaller clumps of fiber to facilitate less overloading of equipment and higher feed rates.

To better appreciate certain aspects of the present invention, a common understanding or definition of the word "tuft" is provided in U.S. Pat. No. 5,606,776 to Freund et al. (hereafter, Freund) assigned to DuPont. In any event, it should be understood that the tufts are rather light, soft, readily deformable and tend to move with and be very reactive to any flow of air in their vicinity.

As noted above, the feed rates of carding equipment and airlay web formers are limited by the size of the largest tufts in the batt. The batts are typically formed by chute feeders which are designed to form a batt f preferably uniform thickness and density. Such chute feeders simply stack the tufts of fiber in a channel having a width approximately that of the carding machine and a thickness of approximately the thickness of the batt. Examples of conventional chute feeders are provided in a number of issued U.S. patents, such as U.S. Pat. Nos. 3,738,476; 4,154,485; 4,449,272; 4,930,190; and 5,157,809. Another example is Freund, mentioned above, which describes an apparatus for removing fiber from bales to form a batt of uniformly distributed fiber that is fed to a web forming mechanism and wherein the apparatus incorporates a chute feeder.

One of the difficulties in handling cut textile fiber is the tendency for fiber in the bin portion of the chute feeder to settle in mounds or piles when it is desirable that the fiber be generally uniformly dispersed. It is a problem whether the fiber is present as individualized fiber filaments, or in clumps, tufts or the like and especially combinations thereof. Non-uniform webs are often formed as a result of the non-uniform distribution in the fiber bed at the inlet side of the chute feeder. The mounds of fiber in the bin cause heavier or denser loaded areas in the batt that correspond generally to the mounds. The denser and heavier portions can be found throughout the process and the effect is observed in the final product by variation in basis weight, particularly in the cross-machine direction.

There have been various approaches to addressing this problem. For example, U.S. application Ser. No. 09/163,679 filed Sep. 30, 1998 and assigned to DuPont is directed to control of the fiber delivery by using several different flow paths to provide a number of small mounds rather than a single large mound. Even though this provides some improvement in the uniformity of the batt, it has been found that further improvement can be made by controlling the flow of the air stream that transports the fiber.

SUMMARY OF THE INVENTION

Accordingly, it is an object of the present invention to overcome the above noted drawbacks of the prior art and to provide improved distribution of fiber in a fiber handling system.

It is an additional object of the present invention to provide a system for receiving fiber and providing a batt having improved lateral basis weight uniformity.

These objects of the present invention are achieved by the provision of a fiber handling apparatus that includes an inlet attached to a pneumatic conveyor system comprising transition ducts capable of directing the air stream above and perpendicular to the fiber bed and slowing the air stream to a velocity such that the fibers fall from the air stream. More specifically, these objects of the present invention are achieved by the provision of a fiber handling apparatus that includes an inlet attached to a pneumatic conveyor system comprising transition ducts which increase in cross-sectional size from the small end at the inlet to the large end where they connect with the bin portion of the chute feeder. The ducts are positioned at an angle from the horizontal sufficient to direct the air stream above and perpendicular to the fiber bed, thereby preventing the incoming airflow from impacting the walls of the transition ducts which would cause undesirable turbulence, and further, the combination of change in cross-sectional size, angle of inclination and length provides for decrease in the air flow velocity.

BRIEF DESCRIPTION OF THE DRAWINGS

The invention may be more easily understood by reference to the accompanying drawings in which.

DETAILED DESCRIPTION OF THE PREFERRED EMBODIMENTS

Freund is directed to imparting a particular arrangement in the batt that facilitates the batt's further processing on a carding machine or some other device known in the textile arts. The subject apparatus as presented in FIG. 2 has structural elements similar to those found in Freund, which is hereby incorporated by reference to the extent that it is consistent with the subject disclosure.

Figure 1:
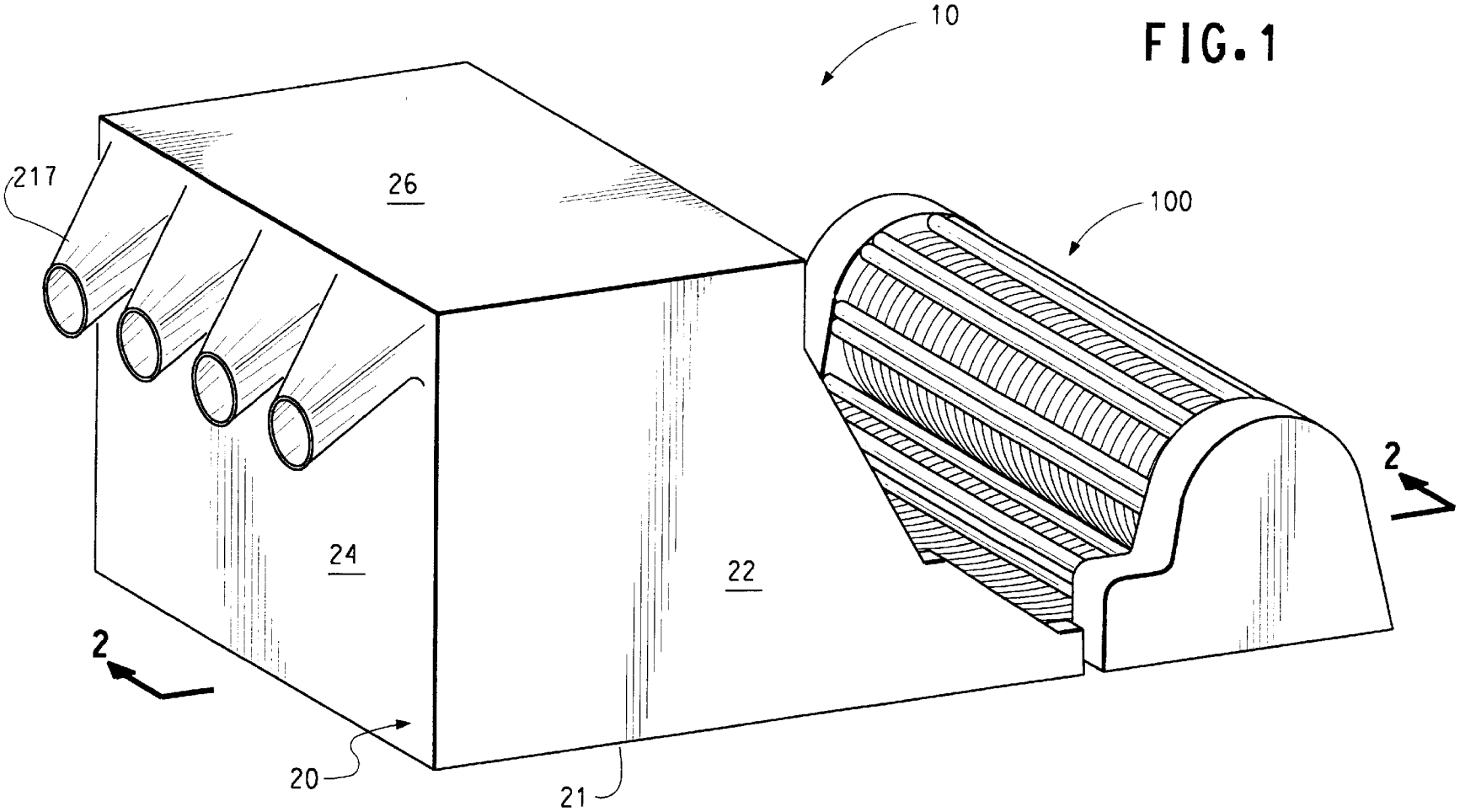
FIG. 1 is a perspective view of a preferred embodiment of a chute feeder arranged to feed a batt to a carding machine.
Figure 2:
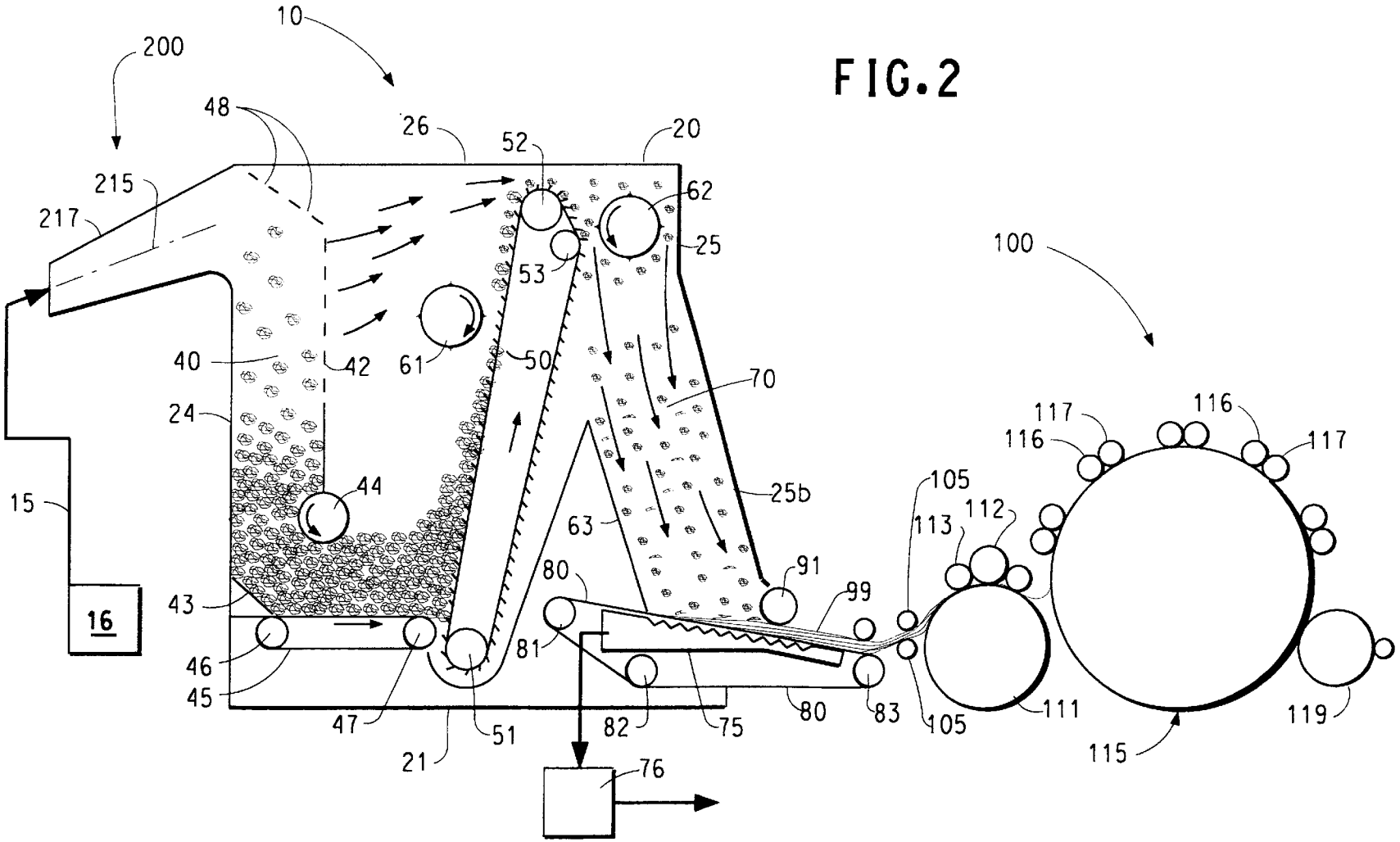
FIG. 2 is a side cross sectional view of the chute feeder and carding machine taken along line 2—2 of FIG. 1.

Referring to FIGS. 1 and 2, the chute feeder is generally indicated by the number 10 and the inlet portion of the chute feeder 10 is generally indicated by the number 200. While the emphasis of the invention is the inlet portion 200, the contribution of the inlet portion would perhaps be better understood if the chute feeder were more fully explained at the outset with the discussion of the operation of the inlet portion 200 being reserved until further into the text where its advantages could be more fully appreciated.

The chute feeder 10 is provided with fiber, as generally indicated by stream 15, which may be provided from a suitable feed source of raw fiber 16 via conventional means, such as a pneumatic conveying system. The source 16, as would be typical of most textile processing plants, would be fiber in tightly compacted bales. The fiber in the bales is taken from the bales and opened up by conventional equipment such as bale breakers, openers and the like and introduced into a pneumatic conveyor system (none of which are shown). The randomly oriented, staple length textile fibers may be in the form of loose, highly lofted tufts. The term "tufts" and "fibers" may be used interchangeably at various places in the specification. The chute feeder 10 is arranged to form a generally continuous batt 99 and to deliver the batt 99 for further processing such as to a carding machine, generally indicated by the number 100.

As shown in FIGS. 1 and 2, the chute feeder 10 comprises a substantially closed housing, generally indicated by the number 20, and in the preferred embodiment is generally defined by a base 21, side walls 22 and 23 (side wall 23 is not shown but is opposite and parallel to side wall 22), a back wall 24, a front wall 25 and a top wall 26. The fiber from source 16 is delivered to a bin portion 40.

The bin portion 40 is essentially a hopper for receiving fiber and providing it to the arrangement for forming a batt. This batt-forming arrangement will be described below. The bin portion 40 is generally defined by the back wall 24, rear portions of the side walls 22 and 23, the top wall 26 and a first dividing wall 42. A conveyor belt 45, carried by rolls 46 and 47, is provided generally at the base of the bin portion 40 to receive the fiber thereon and move it forward in the chute feeder 10. The conveyor belt 45 preferably extends the width of the bin portion 40 and may include a rough surface, slats, or the like to carry the fiber along therewith. A short ramp wall 43 extends downwardly from the back wall 24, at an angle thereto, to a portion of the conveyor belt 45 generally at the roll 46 to substantially direct fiber onto the conveyor belt 45 so that the fiber does not pass around the conveyor 45 and get down to the bottom wall 21.

The dividing wall 42 is spaced from and generally parallel to the back wall 24 to form the generally rectangular cross sectional bin 40. Other cross sectional shapes may also be suitable, but it is preferred that the fibers are distributed laterally to the width of the batt to be formed by the chute feeder 10. It is preferred, as shown, that the chute feeder be comparable to the operating width of the carding machine 100 or whatever textile equipment is to receive the batt 99. The dividing wall 42 may include perforations 48 as generally indicated in FIG. 2 to allow additional air carrying the fibers to separate therefrom and pass through and out of the bin portion 40 as indicated by the arrows. The extreme upper portion of the dividing wall 42 preferably is inclined at an angle to the horizontal because if the wall were vertical it could allow undesirable collection of fiber on the wall. An angle of about 45° would be desirable.

A rotating drum roll 44 is positioned at the base of dividing wall 42, and works in conjunction with the conveyor 45 to carry the bulk fiber in the bin portion 40 to the base of the inclined conveyor belt 50. The roll 44 may also include a coarse surface to better move the fiber forward in the system, as would be known by those versed in the art.

The inclined conveyor belt 50 is carried by rolls 51, 52 and 53, and preferably extends the width of the housing 20 of the feeder 10. The belt 50 preferably includes spikes or other conventional implements thereon to lift fiber at a relatively steep angle (approximately 60 to 85 degrees from the horizontal) to overlie a chute portion, generally indicated by the number 70. With the spikes on the conveyor belt 50 lifting up through a mound of fiber piled against the base thereof, the conveyor belt 50 continuously collects a substantially uniform amount of fiber for delivery to the chute portion 70, considered in both the machine direction (MD) and the cross machine direction (XD). Leveling roll 61 is arranged to knock off excess fiber from the conveyor belt 50 and return it to the mound formed at the base thereof and therefore render a more uniform delivery of fiber to the chute portion 70. Leveling roll 61 rotates counter to the movement of the conveyor belt 50 and may include spikes, pins or brushes to sweep away fiber that is not well secured on the spikes of the conveyor 50.

As noted above, the upper portion of the conveyor 50 overlies a chute portion 70. The chute portion 70 is a substantially vertically oriented channel having a relatively large, generally rectangular cross section and is generally defined by the front wall 25, the front portions of side walls 22 and 23, top wall 26 and the conveyor belt 50. At the bottom of the chute portion 70, is a foraminous conveyor belt 80 carried by rolls 81, 82 and 83. A chute ramp 63 is positioned to extend downwardly from about the midpoint of the conveyor belt 50, at an angle thereto, to a portion of the conveyor 80 generally at the roll 81 to direct the fiber onto the conveyor 80 in a fashion similar to the action of the short ramp wall 43 in the bin portion 40. One of the notable attributes of the chute portion 70, as will be explained in more detail below, is the substantial dimension at its base or, more particularly, at the conveyor belt 80. In the preferred embodiment, the base is approximately three and a half feet long in the machine direction. It is also preferred that the chute portion 70 has at least a constant horizontal cross section or more preferably a continually increasing horizontal cross section descending from the upper portion to the base.

The conveyor belt 80, as noted above, is foraminous to allow air to pass therethrough while collecting the fiber thereon. Immediately below the conveyor belt 80, and running coextensive therewith, is a vacuum box 75 which underlies and supports the conveyor belt 80. The vacuum box 75 extends across the width of the chute feeder 10 and coextends with the conveyor 80 for a substantial portion of the upper run between rolls 81 and 83. The vacuum box 75 is connected to a blower 76, of conventional design, to draw air down through the conveyor 80. Optionally, the blower 76 may form part of the pneumatic conveyor system.

The chute portion 70 is arranged such that fiber is received from the conveyor 50 and proceeds down the chute portion 70 to the conveyor belt 80. The chute feeder 10 includes an entrainment roll 62 adjacent the upper roll 52 of the conveyor belt 50 to disperse the fiber into the air flow moving down the chute portion 70. The fiber is separated from the conveyor belt 50 by the rapidly flowing air at the top portion thereof. As best seen in FIG. 2, there is a rather narrow channel for the air to flow through between the portion of the top wall 26 and the upper portion of the conveyor 50. The air flow as indicated by the many arrows in the FIG. 1 is concentrated in the narrow channel causing relative higher speeds for dislodging the fiber and then carrying the fiber into the upper portion of the chute portion 70. Preferably about half of the air flow (and the fiber being carried by such air) goes over the top of the entrainment roll 62 while the other half goes under (or between the entrainment roll 62 and the conveyor 50) so as to fully disperse the fiber across the cross section of the chute portion 70. It is noted that the air stream as shown by the arrows contain virtually no fiber after passing through dividing wall 42. The air stream then picks up the fibers again when they are transported from the fiber bed up conveyor 50 to the top of chute portion 70. The fiber is dispersed in and controlled by an air flow which descends own the chute portion 70 so as to appear like a heavy snow storm. The downward moving air flow passes through the foraminous belt 80 and continues into the vacuum box 75 and on to the blower 76.

Figure 3:
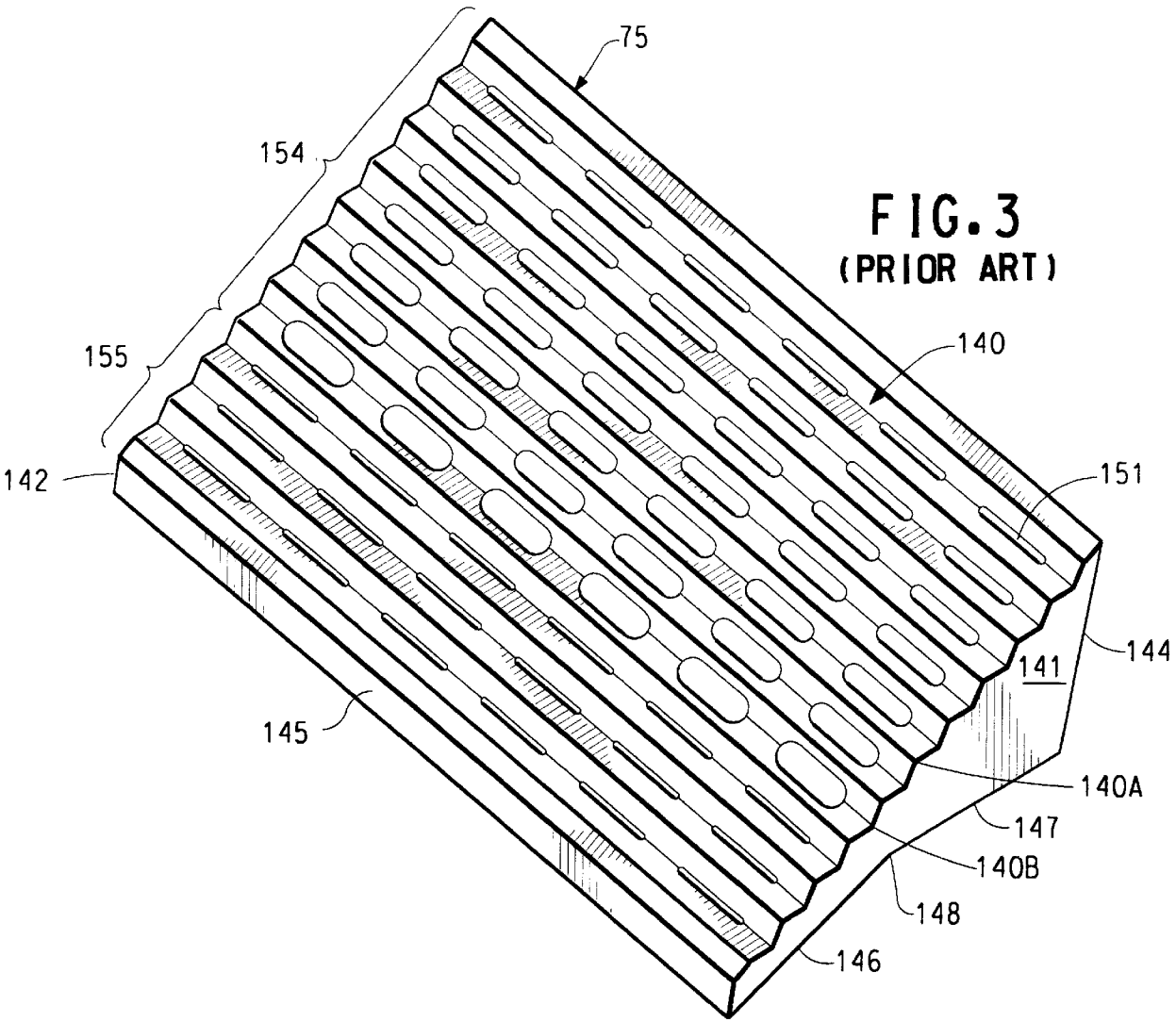
FIG. 3 (PRIOR ART)
FIG. 3 is a perspective view of the suction box taken out of the chute feeder but which is used in the chute feeder, in part, to obtain an overlapping shingle feature of the batt.

The vacuum box 75, as best seen in FIG. 3, comprises a substantially closed box generally comprising a corrugated upper panel 140, side panels 141 and 142, back panel 144, front panel 145, a first bottom panel 146 and a second bottom panel 147. The two bottom panels 146 and 147 intersect at a junction line 148. The corrugated upper panel 140 has a surface which is best understood by reference to the drawings. In particular, the surface is configured with alternating peaks 140A and valleys 140B running generally transverse to the belt 80. Each of the peaks 140A and valleys 140B are preferably arranged such that they are relatively sharply angled. Thus, the portions of the corrugated upper panel 140 which are between the peaks 140A and valleys 140B are generally flat portions arranged at an angle to the belt 80 which overlies the corrugated upper panel 140. The corrugated upper panel further includes a number of openings 151 therein arranged at or near the valleys 140B in extending transversely across the vacuum box 75.

Before proceeding further with the description of the openings in the corrugated upper panel 140, it should be noted that the vacuum box 75 functions as a conduit through which air is pulled down through the belt 80 in a particular fashion. The vacuum box can be divided into two distinct sections. A first section may be generally identified as the laydown portion 154 which generally extends across the width of the vacuum box and from the back panel 144 to about the junction line 148. The second section is the holddown portion 155 and it comprises the remainder of the vacuum box which is fully across the box and from the junction line 148 to the front panel 145. The laydown portion 154 may be characterized in that it has openings 151 which, as clearly shown in the drawings, are arrayed such that each succeeding valley 140B starting from the back panel 144 has a slightly larger width or dimension than the openings in the preceding valley. The holddown portion 155 may be characterized by having openings 151 which are smaller than most if not all the openings in the laydown portion 154 and all the openings in all the valleys are approximately the same dimension.

The relative sizes of the laydown portion 154 to the holddown portion is preferably about three quarters laydown portion to one quarter holddown portion. However, it is anticipated that a suitable range would be to have ratio be roughly half each up to about 90 percent laydown and 10 percent holddown. In the preferred embodiment, the dimension of the openings transitions from about 24 total square inches in each valley up to about 50 square inches maximum total area. The openings in the holddown portion of the upper panel are about 16 square inches total area per valley. However, there are many factors which should be considered when designing for balanced flow such as the desired basis weight of the batt to be formed, the denier of the fiber used in the chute feeder, and the flow characteristics of the foraminous belt, etc.

The reason for the progressively larger series of openings 151 followed by several smaller dimension openings may be best understood by reference to FIG. 2. The tufts are provided into the top of the chute portion 70 and are carried down to the surface of the foraminous belt 80 with the air flow therein. As a batt forms on the foraminous belt 80, the air flow which is intended to pass therethrough encounters greater resistance where the batt is thickest. The batt would inherently be thinnest near the roll 81 and thickest near the roll 91. Without variation in the openings 151 in the laydown portion 154, the air flow would tend to concentrate at the portion of the belt 80 near the roll 81. However, by varying the dimension of the openings, the air flow is generally balanced over the entire laydown portion 154. As such, the batt being formed accumulates fiber thereon in a more uniform manner. In other words, the resistance of air flow through the corrugated upper panel 140 is preferably arranged such that it offsets the increase in resistance created by fiber collecting on the belt 80.

As a result, the tufts actually form thin layers or shingles, which successively overlap in a manner that each successive shingle is slightly offset in the machine direction from the one below it. The formation of the shingles is clearly the result of the air being drawn down through the belt 80 and the tufts being so light to follow the air flow. The air naturally takes the path of least resistance which is where the fiber batt is the thinnest and the tufts that follow the air flow will quickly fill the voids. This process occurs continuously and is difficult to see when watching the chute feeder in operation. However, the batt 99 has clearly discernible layers formed therein that can be seen upon close inspection and disassembly of the batt 99. The improved operation of the textile machinery to which the batt is fed is also quite discernible.

In addition to forming thin shingles of generally uniform thickness, the system provides a naturally self-balancing lateral distribution of the fibers across the width of the batt to be formed. Uniformity of the batt (in terms of basis weight) across the width thereof is a particular concern as it is important for product quality as well as efficient use of raw material. A batt that has thin portions is not acceptable to customers and product that has excessively thick portions is wasteful of fiber (if it is acceptable for its intended use). The lateral distribution is accomplished in generally the same manner as described above, in that the air flow will favor the path of least resistance. The least resistance will be where the batt is the thinnest. As the air flow moves to the thinnest portion of the batt, it brings additional fiber with it which brings the amount of fiber at the thin portion up to a more uniform distribution. Although a certain amount of lateral uniformity is achieved when the batt is so formed, the subject invention provides an even greater degree of uniformity.

As described above, the adjacent layers or shingles within the batt are slightly offset from one another in a longitudinal direction because of the movement of the belt 80. The number of shingles which form the thickness of the batt 99 is dependent on a number of factors including the designed basis weight or total thickness of the batt 99, the length of the base of the chute portion 70, the nature of the tufts and the rate of operation of the chute feeder 10. By reference to FIG. 4, which will described in more detail below, there is illustrated a batt having about three and a half to four shingles in thickness when cut perpendicular to the length of the batt 99. In the preferred arrangement the batt would have more shingle layers, but for drawing clarity, the drawing shows fewer layers.

Referring again to FIGS. 2 and 3, once the batt 99 is formed on the belt 80 in the laydown portion 154, it passes under roll 91. Thereafter, the batt 99 is held down on the belt 80 over the holddown portion 155 of the vacuum box 75 in preparation for feeding to the card 100. The holddown portion tends to keep the batt from expanding significantly and also prevents it from being pulled back under the roll 91 by the very strong air flow in the laydown portion 154. The smaller dimension openings in the holddown portion 155 are suited to allow sufficient air flow therethrough to hold down the batt 99 substantially in its compressed state until the batt is to be pinched between subsequent rollers.

The compressed batt 99 is thereafter suited for delivery to the card 100. Carding machines are very old and well known and the card 100 is intended to represent any conventional design. In particular, the card 100 includes suitable feed rolls 105 which maintain the tight squeeze on the batt 99 as it is fed to lickerin roll 111. Lickerin roll 111 has a plurality of sharp needle like teeth for picking up the fiber from the batt 99. The lickerin roll 111 rotates substantially faster than the rate at which the batt 99 is fed thereto; however, with the batt tightly pinched between feed rolls 105 and the tufts arranged in overlapping shingles, the lickerin 111 is not able to easily pull out entire tufts intact. In the drawing, the lickerin 111 is provided with stripper and worker rolls 112 and 113.

The card 100 further includes a main carding roll and a plurality of stripper and worker rolls 116 and 117 both associated with the lickerin and with the main carding roll 115. The fiber that has been carded is then doffed by doffing roll 119 and discharged from the card. Once the fibers are carded they are more thoroughly separated from one another and arranged generally parallel to one another in the machine direction.

Although the card 100 has been described as being conventional, using the batt formed by this process and apparatus enables an operator of a conventional card to increase its throughput dramatically. Typically, cards are not able to be fed substantial rates of fiber because cards become quickly overloaded rendering product with many neps and streaks which are very difficult if not impossible to remove. If the overloading is substantial and for extended periods of time, the card may overheat and melt most polymer fibers. While this is rare and very unlikely under present operating scenarios, using conventionally assembled batts at the feed rates that have been found possible with the chute feeder of the present invention would cause significant streaking, nepping, overheating and perhaps many other significant but uncommon problems. However, in contrast to such beliefs or expectations, carding machines have been found to be able to produce quality product at the significantly higher feed rates. The difference is not that more fiber is being loaded onto fully loaded portions of the card, but that the new batt is able to more fully utilize the full capacity of the card.

To put this in other terms, when using a conventional batt, full tufts are picked up by the lickerin. If a large tuft or a clump of tufts is picked up by the lickerin whole, the card would probably be overloaded at that position and the web product would reveal the consequences. The conventional manner of avoiding this likelihood is to set the feed rate so that the card has the opportunity to handle large tufts. Thus, the feedrate across the full width of the card would be considerably irregular such that in some places, a tuft is being pulled in and the rate is at a maximum, while at others, there is little being added to the card and the feed rate is substantially below capacity. The feedrate across the width of the card is normalized such that the there are fewer and less radically low feedrate portions across the width of the card. The tufts in the new batt are either dismantled as the fiber therein is picked up by the lickerin or the tuft remains somewhat intact but significantly drafted out. It may be helpful to visualize the batt of the present invention being "nibbled" by the lickerin roll in a substantially uniform manner across the width thereof rather than the irregular "bites" of individual tufts being fed from a conventionally formed batt.

A way of filling in the gaps on the carding roll has been developed so that more of the card is operating at or near capacity. As noted above, test results indicate that obtaining a feed rate improvement (i.e. the rate at which the batt is fed to the carding machine and not the speed at which the carding machine is run) of at least three times conventional feed rates is feasible while even higher feed rates are envisioned.

Figure 4:
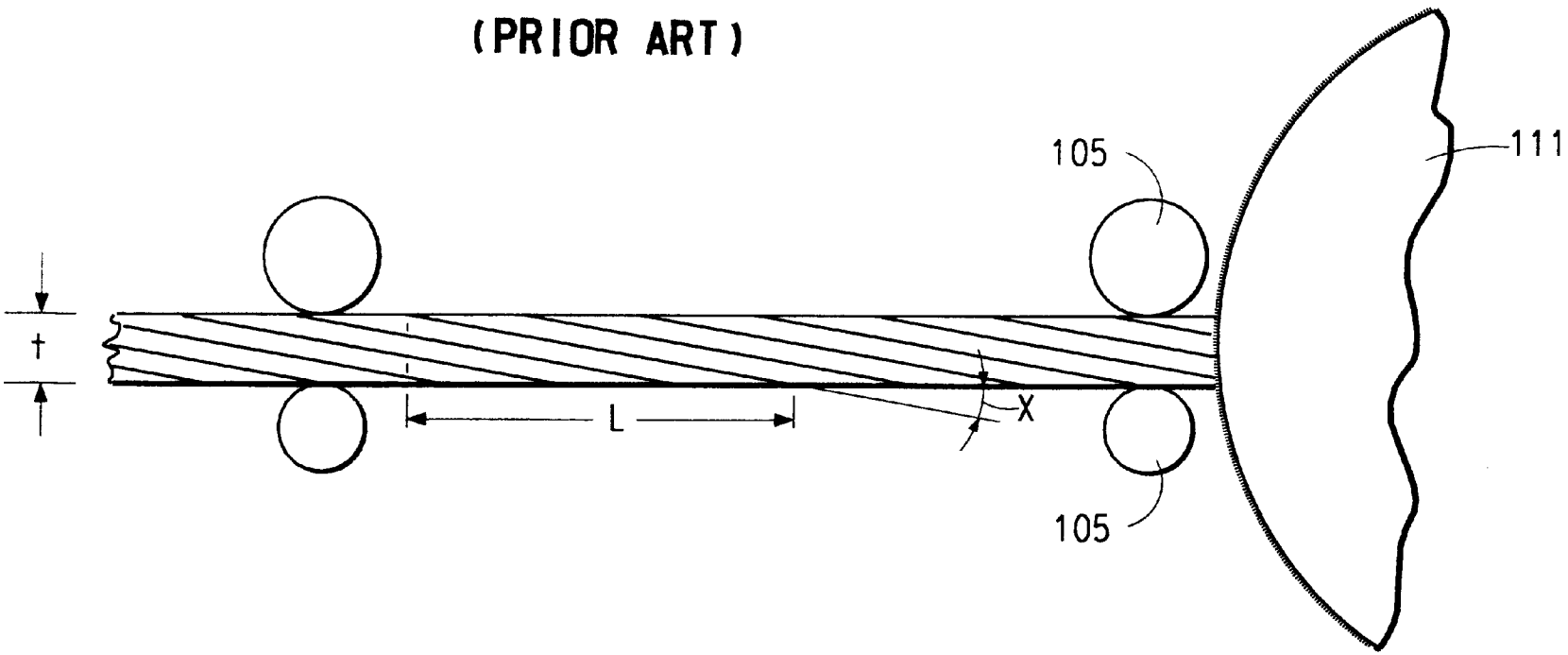
FIG. 4 (PRIOR ART)
FIG. 4 is an enlarged fragmentary view of the compressed batt particularly showing the overlapping shingle structure of the batt.

A section of the batt 99 is enlarged in FIG. 4 to more clearly show the angle of the shingles to the batt. In the preferred embodiment, the angles and lengths of the shingles are more extreme than shown, but for purposes of explanation and clarity, the angle and length dimension are shown as being less substantial. However, this notable difference between what would be preferred and what is illustrated should not have a bearing on what is covered by the claims which follow this description.

Continuing with the description of FIG. 4, the batt 99 is illustrated as being compressed between rolls wherein the dimensions of interest are the lengthwise dimension component L of the shingle in the batt 99, the thickness of the compressed batt t, and the angle X formed by the length L and thickness t. By simple trigonometry, the angle of the shingle in the batt may be derived by obtaining the arctan of t/L. This angle or the plane in which the shingle lies may also be described as the tuft plane since this is the general plane in which the flattened tufts are arranged. It should further be understood that these dimensions and angles are measured while the batt 99 is compressed. Since the batt is intended to be fed to a textile machine, the batt 99 will most likely be compressed between rolls to control the delivery of the batt. Because this primarily relates to the form of the batt as it is delivered to the equipment, the measurement is most relevant in its compressed state.

It is also illustrated in FIG. 4 that the batt is fed in a somewhat radial orientation to the lickerin 111. The lickerin 111, as is conventional, has a card clothing exterior surface which includes many teeth. By arranging the shingles or tuft at the angle illustrated, the compressive forces exerted by the feed rollers 105 cause adjacent tufts to hold the remaining portions of the tuft in the batt while the fibers at the edge of the tuft are pulled out of the tuft without being able to easily pull the remainder of the tuft out.

In actual use trials of chute feeders it was found that large voids were being formed in the fiber bed and that the fibers were being churned violently through the fiber bed. It was believed that these effects on the fiber bed were the result of uncontrolled air flow at excessive speeds as the air stream entered the top part of the bin of the chute feeders and was forced down through the fiber bed.

The conclusions from the aforementioned online testing were confirmed by using Computational Fluid Dynamics (CFD) software from Fluent, Inc. (Lebanon, N.H.). It was found that the disturbance of the fiber bed in the conventional chute feeders was caused by high-speed, nonuniform air flow being directed onto the fiber bed by the chute feeder inlets. The speed of the air stream in the inlet pipes was found to be as high as 20 m/s in the positive vertical (upward) direction. It was found that the air stream in the chute feeder disclosed in the Freund patent could have a speed as high as 5 m/s in the negative vertical (downward) direction. Such a high air stream speed impinging on the fiber bed can result in the aforementioned non-uniformities.

Concentrating on the inlet portion 200 in the FIG. 2, it is arranged to receive the fiber from source 16 as indicated by stream 15 by conventional means such as a pneumatic conveying system. The pneumatic conveying system is in communication with transition ducts 217 that transport the air stream 15 to the top of bin portion 40 of the chute feeder 10. The fiber is dispersed in and controlled by the air stream. It should be noted that throughout the specification, the terms "fiber", "air", "air stream", "airflow" and the like may all, depending on context, refer generally to a stream or flow of air transporting fibers. Although not shown, the pneumatic conveying system may, as needed, comprise inlet pipes that connect to the small ends of the transition ducts 217 to provide a straightening effect to the air stream before it enters the transition ducts 217. Such inlet pipes may be needed if the arrangement of the pneumatic conveying system would otherwise cause the air stream to enter the transition ducts 217 so that the air stream would impact on the walls of the ducts.

The speed of the air stream is important in determining how the fiber bed may be formed. When the speed just above the fiber bed is too high, the fibers are retained in the air stream and also turbulence is created which thereby contributes to the undesirable non-uniformity in the fiber bed. However, when the air flow is slowed sufficiently the fiber can precipitate out from the air stream and descend relatively slowly within the bin portion 40 so as to appear like a snowfall and thereby form the desired uniform fiber bed. It has been found that under certain conditions the speed of the air stream should be less than about 2 m/s.

This desired reduction in the speed of the air stream is accomplished by the transition ducts 217 which typically increase in cross-sectional size from a relatively smaller end to a relatively large end at the juncture with bin portion 40. As shown in FIG. 2, the axis 215 of duct 217 is at an angle of about 10 degrees from the horizontal. This angle is not expressly limited to 10 degrees, but rather is chosen to cause the airflow speed to decrease to a speed low enough to prevent the incoming airflow from impacting the walls of the transition ducts 217 or the walls of the chute feeder at the top of the bin portion 40. The transition ducts 217 may be of any shape, but are typically circular and there should be about a three-fold increase from the small end to the large end at the outlet at the top of bin portion 40 of the chute feeder. One embodiment would have a cross-sectional size of about 1 m at the large end that decreases to about 0.3 m at the small end. In addition to controlling the speed of the air stream, the transition ducts 217 direct the air stream so that the greater part of the air stream does not travel vertically downward and impinge on the fiber bed, thereby causing turbulence and holes in the fiber bed. The transition ducts 217 address this problem by directing the air stream above and perpendicular to the fiber bed and generally toward the top of conveyor 50. Thereby, the transition ducts 217 substantially eliminate the holes and other non-uniformities in the fiber bed.

Figure 5:
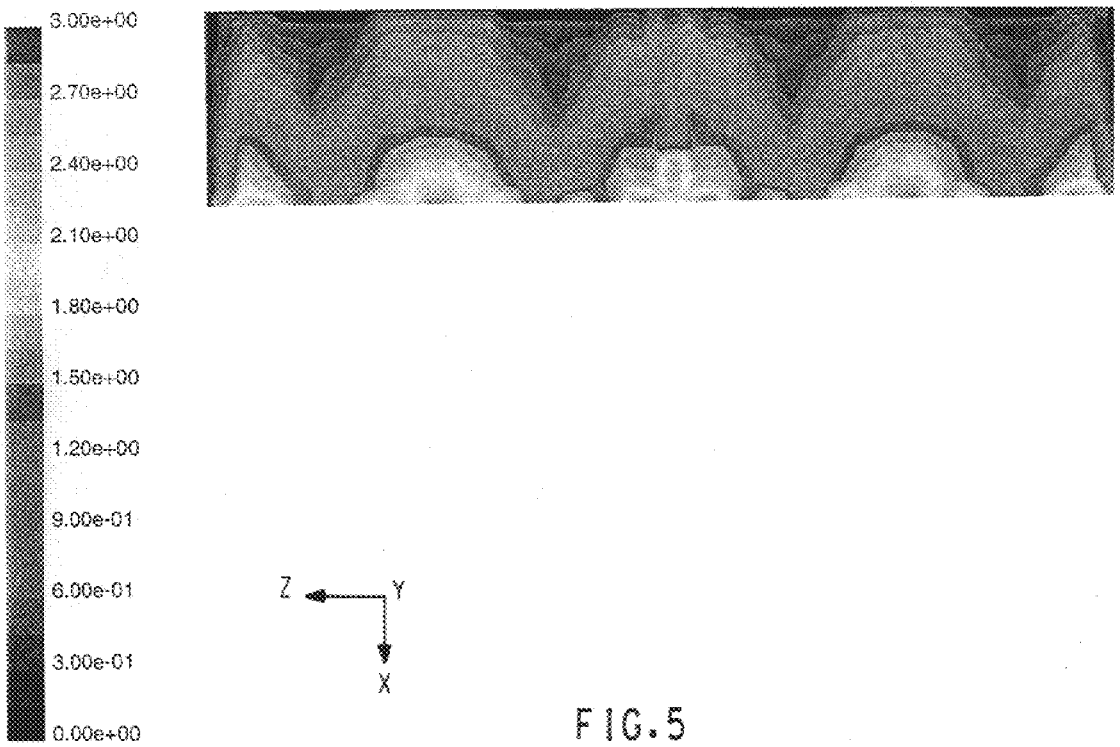
FIG. 5 presents a graphical representation of the air flow in the upper layers of a fiber bed as would be formed using a conventional chute feeder.
Figure 6:
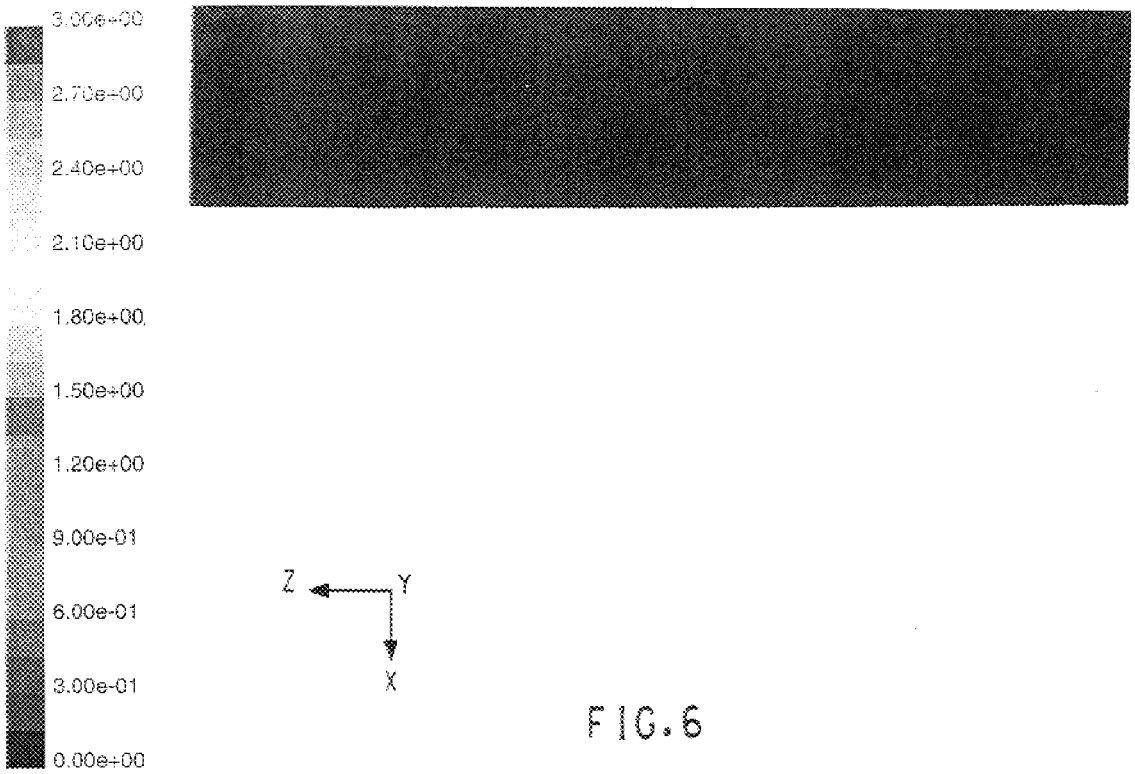
FIG. 6 presents a graphical representation of the air flow in the upper layers of a fiber bed as would be formed using the chute feeder of the claimed invention.

A conventional chute feeder and the claimed chute feeder were both modeled using the CFD program and the speed of the air flow into the respective fiber beds of each was determined. FIG. 5 presents a CFD graph of the air flow in the upper layers of a fiber bed as would be formed using a conventional chute feeder. FIG. 6 presents a CFD graph of the air flow in the upper layers of a fiber bed as would be formed using the chute feeder as in the claimed invention. The graphs in the Figures depict the speed of the air flow in the upper layers of the respective fiber beds with lower speeds indicative of increased uniformity. As such, the uniformity of the fiber bed with the claimed invention is presented as much better than that achieved with conventional chute feeders.

We claim:

1. A device comprising at least one tapered transition duct for transporting fibers from a feed source entrained in an air stream into a generally open top portion of a chute feeder comprising a bin portion for receiving the fiber to form a fiber bed, the at least one tapered transition duct having a small end and a large end connected to the bin portion and a main axis at an angle of about 10° to the horizontal, whereby the air stream in the transition duct decreases in speed at the top of the bin portion sufficiently to cause the fibers to fall from the air stream and the air stream is directed above and perpendicular to the fiber bed.

2. A system for assembling a continuous stream of loose, highly lofted tufts of randomly oriented staple length textile fibers into a generally continuous fiber batt comprised of substantially elongated shingles suited for high speed delivery to textile processing equipment such as a carding machine, wherein the system comprises:

a substantially perforate conveyor belt having an upper surface for receiving the tufts thereon thus forming the batt on said upper surface;

means for moving said perforate conveyor belt along a predetermined path defining a machine direction;

a generally vertically oriented chute arranged generally over top of said conveyor belt having generally open top and bottom portions, generally closed side and front and back walls, wherein said front and back walls are arranged to span said perforate conveyor belt and said side walls extend along the machine direction generally adjacent opposite edges of said perforate conveyor belt, and particularly wherein said chute defines a substantially open free fall path for the tufts to descend from the top portion to said perforate conveyor belt;

means for delivering the tufts to said generally open top portion of said chute including a bin portion for receiving the fiber from a feed source to form a fiber bed, an inclined conveyor for lifting fiber continuously from the fiber bed in the bin portion and depositing the fiber into said vertically oriented chute, means for drawing air generally from above said upper surface of said substantially perforate conveyor belt down through said substantially perforate conveyor belt such that air transmission through the belt is substantially uniform along the machine direction taking into consideration that there will be more fiber nearer to said front wall of said chute as compared to said back wall of said chute;

whereby the batt is formed of continuous overlapping shingles which are suited for being controllably administered to a carding machine with reduced likelihood of permitting an entire tuft to be taken into the carding machine at once, the improvement wherein means for delivering the fiber in an air stream from the feed source to the bin portion comprises at least one tapered transition duct having a main axis at an angle to the horizontal and having a small end and a large end with the large end connected to the bin portion and whereby the air stream in the transition duct undergoes a decrease in speed at the top of the bin portion and the stream is directed above and perpendicular to the fiber bed.

3. The system according to claim 2, wherein the air stream speed decreases to less than about 2 meters per second.

4. The system according to claim 2, wherein the main axis of the transition duct is at an angle of about 10° to the horizontal.

5. The system according to claim 2, wherein the transition duct has about a three-fold increase in cross section from the small end to the large end.

6. The system,according to claim 2, further including a narrow channel to create a high speed air stream to lift the fiber from the inclined conveyor.

7. The system according to claim 6, further including an entrainment roll to mechanically dislodge fiber tufts remaining on the conveyor above said chute, and wherein the system is arranged so that the air stream has an approximately balanced flow of fiber passing over and under the entrainment roll.

8. The system according to clam 2, wherein the shingles overlap preceding shingles and are arranged at an angle of less than 40 degrees from the belt.

9. The system according to claim 8, wherein the shingles are arranged at an angle of less 25 degrees from the belt.

10. The system according to claim 9, wherein the shingles are arranged at an angle of less than 10 degrees from the belt.

11. The system according to claim 2, wherein the batt comprises a thickness of at least 5 shingles.

12. The system according to claim 11, wherein the batt comprises a thickness of at least 10 shingles.

13. A combination of a carding machine and a chute feeder wherein the chute feeder receives a continuous stream of loose, highly lofted tufts of randomly oriented staple length textile fibers and creates a generally continuous fiber batt comprised of substantially elongated shingles for high speed delivery to said carding machine which combs and separates the fibers for subsequent treatment, wherein the combination includes:

a substantially perforate conveyor belt having an upper surface for receiving the tufts thereon thus forming the batt on said upper surface;

means for moving said perforate conveyor belt along a predetermined path defining a machine direction;

a generally vertically oriented chute arranged generally over top of said conveyor belt having generally open top and bottom portions, generally closed side and front and back walls, wherein said front and back walls are arranged to span said perforate conveyor belt and said side walls extend along the machine direction generally adjacent opposite edges of said perforate conveyor belt, and particularly wherein said chute defines a substantially open free fall path for the tufts to descend from the top portion to said perforate conveyor belt;

means for delivering the tufts to said generally open top portion of said chute including a bin portion for receiving the fiber from a feed source to form a fiber bed, an inclined conveyor for lifting fiber continuously from the fiber bed in the bin portion and depositing the fiber into said vertically oriented chute, means for drawing air generally from above said upper surface of said substantially perforate conveyor belt down through said substantially perforate conveyor belt such that air transmission through the belt is substantially uniform along the machine direction taking into consideration that there will be more fiber nearer to said front wall of said chute as compared to said back wall of said chute;

whereby the batt is formed of continuous overlapping shingles: and a carding machine including a lickering roll, a main carding roll arranged to receive fiber from the lickerin roll, stripper and worker rolls for lifting fiber from the main card roll and combing the same and replacing the same back on the carding roll and a doffing means for taking fiber off the main card roll, wherein the batt fed onto the lickering roll is controllable administered so that an entire tuft is unlikely to be taken thereon at one time, the improvement wherein the means for delivering the tufts from the feed source to the bin portion comprises at least one tapered transistion duct having a main axis at an angle to the horizontal for transporting an air stream having a small end and a large end connected to the bin portion, and whereby the air stram in the transistion duct undergoes a decrease in speed at the top of the bin portion and the stream is directed above and perpendicular to the fiber bed.

14. The combination according to claim 13, wherein the air stream speed decreases to less than about 2 meters per second.

15. The combination according to claim 13, wherein the main axis of the transition duct is at an angle of about 10° to the horizontal.

16. The combination according to claim 13, wherein the transition duct has about a three-fold increase in cross section from the small end to the large end.

17. The combination according to claim 13, wherein the shingles overlap preceding shingles and are arranged at an angle of less than 40 degrees from the belt.

18. The combination according to claim 17, wherein the shingles are arranged at an angle of less than 25 degrees from the belt.

19. The combination according to claim 18, wherein the shingles are arranged at an angle of less than 10 degrees from the belt.

* * * * *